US009931831B2

(12) United States Patent
Ishikawa

(10) Patent No.: US 9,931,831 B2
(45) Date of Patent: Apr. 3, 2018

(54) WEB PRINTING PRESS

(75) Inventor: Akira Ishikawa, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/075,048

(22) Filed: Mar. 29, 2011

(65) Prior Publication Data

US 2011/0239882 A1 Oct. 6, 2011

(30) Foreign Application Priority Data

Apr. 6, 2010 (JP) ..... 2010-087552

(51) Int. Cl.

| | |
|---|---|
| ***B05C 9/08*** | (2006.01) |
| ***B41F 23/04*** | (2006.01) |
| ***B41F 7/26*** | (2006.01) |
| *B41M 7/00* | (2006.01) |

(52) U.S. Cl.

CPC ..... *B41F 23/0409* (2013.01); *B41F 7/26* (2013.01); *B41F 23/0443* (2013.01); *B41M 7/0045* (2013.01); *B41M 7/0081* (2013.01)

(58) Field of Classification Search

CPC .... B41F 7/26; B41F 23/0409; B41F 23/0443; B41M 7/0045; B41M 7/0081

USPC ..... 101/217, 488, 491; 118/46, 223, 620

See application file for complete search history.

(56) References Cited

U.S. PATENT DOCUMENTS 5,212,271 A * 5/1993 Beckett ..... G03F 7/031 427/494
5,840,788 A * 11/1998 Lutz ..... A63B 37/0003 40/327
7,510,277 B2 * 3/2009 Konno et al. ..... 347/102
2001/0001392 A1 * 5/2001 Hirae ..... B08B 3/08 134/1.3
2001/0009701 A1 * 7/2001 Schmitt ..... 427/559
2004/0259975 A1 * 12/2004 Robillard ..... 523/160
2007/0228289 A1 * 10/2007 Kaszuba ..... B05D 3/067 250/492.1
2007/0289466 A1 * 12/2007 Bock et al. ..... 101/424.1
2008/0282974 A1 * 11/2008 Takemata ..... 118/620

(Continued)

FOREIGN PATENT DOCUMENTS

DE 3256082 * 1/1987 ..... B01J 19/12
EP 1 992 486 A1 11/2008

(Continued)

OTHER PUBLICATIONS

"Innovative UV-LED-Trocknung auf der Gallus ECS 340", Aug. 31, 2009, Retrieved from the Internet: URL:http://www.gallus-group.com/Portaldata/1/Resources/01_group/02_media/pressarticles/Press_Release_UV_090917_Deutsch.pdf.

(Continued)

*Primary Examiner* — Leslie J Evanisko
*Assistant Examiner* — Marissa Ferguson Samreth
(74) *Attorney, Agent, or Firm* — Womble Bond Dickinson (US) LLP

(57) ABSTRACT

A web printing apparatus includes a transfer device which transfers highly reactive ink/varnish onto a web, and a fixing device which fixes, on the web, the highly reactive ink/varnish transferred by the transfer device. The fixing device includes only a light irradiation device which irradiates the web with light in the wavelength range, in which no ozone is generated, to cure the highly reactive ink/varnish on the web without thermal drying of the web.

6 Claims, 5 Drawing Sheets

(56) References Cited

U.S. PATENT DOCUMENTS

| | | | | |
|---|---|---|---|---|
| 2009/0269510 | A1* | 10/2009 | Lieberman et al. | 427/555 |
| 2010/0012028 | A1* | 1/2010 | Jinbo et al. | 118/702 |
| 2010/0096564 | A1* | 4/2010 | Yang | B82Y 10/00 250/492.1 |
| 2011/0192297 | A1* | 8/2011 | Laksin et al. | 101/153 |

FOREIGN PATENT DOCUMENTS

| | | | |
|---|---|---|---|
| JP | S54-123305 | A | 9/1979 |
| JP | 57-123058 | | 7/1982 |
| JP | 60-002364 | | 1/1985 |
| JP | 61-158451 | | 7/1986 |
| JP | 6-500737 | | 7/1991 |
| JP | 05-116489 | | 5/1993 |
| JP | 09-184903 | | 7/1997 |
| JP | 11-254540 | | 9/1999 |
| JP | 2003-045211 | A | 2/2003 |
| JP | 2003-136697 | | 5/2003 |
| JP | 2003127517 | | 5/2003 |
| JP | 2004-009359 | A | 1/2004 |
| JP | 2004-351757 | A | 12/2004 |
| JP | 2005-153330 | A | 6/2005 |
| JP | 2006-163046 | | 6/2006 |
| JP | 2008-100493 | | 5/2008 |
| JP | 2008-307891 | A | 12/2008 |
| JP | 2008-308341 | A | 12/2008 |
| JP | 2009-511939 | A | 3/2009 |
| JP | 2009-173712 | | 8/2009 |
| WO | WO 93/02329 | | 2/1993 |
| WO | WO 2007/064102 | A1 | 6/2007 |

OTHER PUBLICATIONS

"Catalogue", *Eye Graphics Co., Ltd.*, (May 2001), pp. 1-5.

Ootagaki, Yoshio, et al., "Equipment of Ultra Violet Radiation", *The Journal of the Japan Society of Colour Material*, vol. 48, No. 5, (1975), pp. 306-314.

Japanese Office Actions dated May 26, 2015 (Application Nos. 2014-125127 and 2014-125128).

Takashi. "Current States of UV Irradiation Devices." Japan Printer, vol. 90, No. 10 (2007). with English translation of relevant portions of pp. 21, 22 and 24.

Yoichi. "UV Curing Technology and Application thereof to the Field of Printing." Japan Printer, vol. 89, No. 6 (2006), with English translation of relevant portions of pp. 17 and 19.

Teruo. "Technology Trend of UV Lamp System for UV Inkjet." Journal of Printing Science and Technology, vol. 45, No. 6 (2008), with English translation of relevant portions of pp. 9 and 15.

Shinobu. "UV/EB Curing System." Journal of Printing Science and Technology, vol. 40, No. 3 (2003), with English translation of relevant portions of pp. 7-9 and 11.

Yuichi. "Future of UV Printing: Proposition of a Hybrid System." Japan Printer, vol. 93, No. 1 (2010), with English translation of relevant portions of pp. 9 and 11.

Yuichi. "New Ultraviolet Curing System named as 'Hybrid UV.'" Journal of Printing Science and Technology, vol. 46, No. 5 (2009), with English translation of relevant portions of pp. 2 and 4.

Haruo. "Principles and Characteristics of LED Curing Inks: Next-Generation UV Curing Inks with Less Environmental Load." Japan Printer, vol. 91, No. 10 (2008), with English translation of relevant portions of pp. 11 and 14.

* cited by examiner

WEB PRINTING PRESS

BACKGROUND OF THE INVENTION

The present invention relates to a web printing press.

Japanese Patent Laid-Open No. 2008-308341 (reference 1) proposes a conventional web printing press. The web printing press described in reference 1 will be described with reference to FIG. 5. A web printing press 201 includes a sheet feeding device 202, two printing units 204 and 205, a fixing device 206 including a thermal dryer 206*a*, a cooling device 207, and a folder 208.

With this arrangement, a web 203 wound in a roll is fed from the sheet feeding device 202 to the printing units 204 and 205, thereby undergoing double-sided printing. The printed web 203 is exposed to hot air from the dryer 206*a* in the fixing device 206, thereby drying the ink printed on the web 203. At this time, upon exposure of the web 203 to hot air, a solvent in the ink transferred onto the web 203 evaporates, so the ink fixes on the paper. After that, the web 203 is wound around cylinders 207*a* to 207*d*, which are called chill rollers and through which cooling water passes, in the cooling device 207, undergoes cutting and folding processing by the folder 208, and is delivered.

On the other hand, a sheet-fed offset printing press prints/coats on a sheet using ultraviolet curing ink/varnish. This can be done using a known printing/coating method of irradiating a printed/coated sheet with ultraviolet rays from an UV (Ultraviolet) lamp to cure ultraviolet curing ink/varnish, as described in Japanese Patent laid-Open No. 54-123305 (reference 2).

In recent years, a printing/coating method which attains both energy saving and a low environmental load has been developed. In this method, ultraviolet curing ink/varnish is cured using a light-emitting diode (LED-UV) which emits light with UV wavelengths in place of a conventional UV lamp, as disclosed in Japanese Patent Laid-Open No. 2008-307891 (reference 3).

In the web printing press disclosed in reference 1 mentioned above, printing is performed using ink called thermal evaporative drying type ink (heat-set ink), and a solvent in the printed ink is forcibly evaporated and removed by hot air using a thermal drying device to fix the ink on the web. However, a web printing press prints at a speed faster than a sheet-fed offset printing press, and therefore requires a large-sized drying device in order to reliably dry the ink. Hence, the former printing press not only requires a large space for accommodation because it has a relatively large size as a whole, but also consumes a large amount of energy to activate the drying device.

The sheet-fed offset printing press disclosed in reference 2 consumes so much energy that the environmental load cannot be reduced.

In the sheet-fed offset printing press disclosed in reference 3, because light emitted by the LED-UV has an extremely narrow wavelength range (e.g., 370 nm to 380 nm), only ink/varnish which reacts to light in this narrow wavelength range can be used as ink/varnish which cures with light from the LED-UV.

SUMMARY OF THE INVENTION

It is an object of the present invention to provide a web printing press which is downsized as a whole and attains both energy saving and a low environmental load.

In order to achieve the above-mentioned object, according to the present invention, there is provided a web printing apparatus including a transfer device which transfers highly reactive ink/varnish onto a web, and a fixing device which fixes, on the web, the highly reactive ink/varnish transferred by the transfer device, wherein the fixing device comprises only a light irradiation device which irradiates the web with light in a wavelength range, in which no ozone is generated, to cure the highly reactive ink/varnish on the web without thermal drying of the web.

DESCRIPTION OF THE PREFERRED EMBODIMENTS

The present invention will be described in detail below with reference to the accompanying drawings.

First Embodiment

Figure 1:
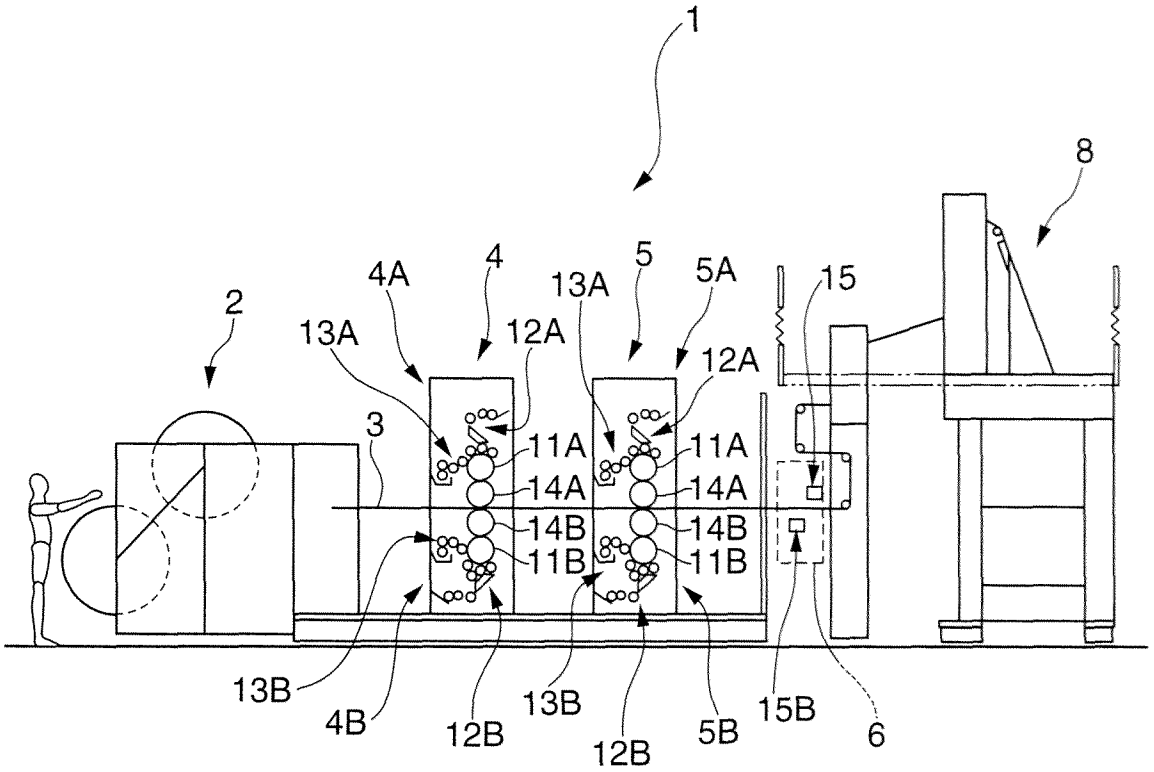
FIG. 1 is a side view of a web printing press according to the first embodiment of the present invention.

The first embodiment of the present invention will be described first with reference to FIGS. 1 to 3.

A web printing press 1 according to the first embodiment includes a sheet feeding device 2 which feeds a web 3 from a roll, printing units 4 and 5 (transfer devices) which print by sequentially transferring highly reactive ink onto the web 3 supplied from the sheet feeding device 2, a fixing device 6 which fixes the ink transferred onto the web 3 by the printing units 4 and 5, and a folder 8 which performs cutting and folding processing of the web 3 delivered from the fixing device 6. The printing units 4 and 5 include obverse side printing units 4A and 5A which print on the obverse surface of the web 3, and reverse side printing units 4B and 5B which print on the reverse surface of the web 3. The fixing device 6 includes only a pair of light irradiation devices 15A and 15B which irradiate the web 3 with light beams having a specific wavelength to dry the ink transferred onto the two surfaces (the obverse and reverse surfaces) of the web 3.

Each of a set of the obverse and reverse side printing units 4A and 4B and a set of the obverse and reverse side printing units 5A and 5B includes plate cylinders 11A and 11B which have printing plates mounted on their circumferential surfaces, inking devices 12A and 12B which supply highly reactive ink (highly reactive liquid) to the plate cylinders 11A and 11B, respectively, dampening devices 13A and 13B which supply dampening water to the plate cylinders 11A and 11B, respectively, and blanket cylinders 14A and 14B which are arranged in contact with the plate cylinders 11A and 11B, respectively. The blanket cylinder 14A of the plate cylinder 11A and the blanket cylinder 14B of the plate cylinder 11B are arranged in contact with each other.

The highly reactive ink supplied to the plate cylinders 11A and 11B means UV ink which cures with low light irradiation energies from the light irradiation devices 15A and 15B, and is also called highly reactive UV ink, high-sensitivity ink, or high-sensitivity UV ink. Such highly reactive UV ink rapidly cures with a light wavelength which has a low light irradiation energy without requiring light having wavelengths which fall within the ozone generation range and have a high light irradiation energy. Various types of inks can be used as the highly reactive ink supplied to the plate cylinders 11A and 11B, as long as a wavelength to which it reacts falls within the wavelength range of light beams emitted by the light irradiation devices 15A and 15B. The ink supplied to the plate cylinders 11A and 11B may be ink which reacts to light having a single wavelength, such as light emitted by an LED, or ink which reacts to light having wavelengths in a certain range.

Each of the dampening devices 13A and 13B includes at least four rollers which are connected in contact with each other, and two rollers which are in contact with each other among the four rollers are rotated so as to produce a counter-slip between them. In this arrangement, a given minimum necessary amount of dampening water is transferred from one roller to the other roller on the downstream side at the contact point between the two rollers. Hence, the dampening water is supplied in an amount optimum for the ink onto the plate surfaces of the printing plates mounted on the plate cylinders 11A and 11B to prevent excessive emulsification of the highly reactive ink supplied from the inking devices 12A and 12B onto these plate surfaces.

The light irradiation device 15A includes an ozoneless lamp (to be described later) which is used for obverse surface irradiation and cures the highly reactive ink transferred onto the obverse surface of the web 3 by the obverse side printing units 4A and 5A. The light irradiation device 15B includes an ozoneless lamp (to be described later) which is used for reverse surface irradiation and cures the highly reactive ink transferred onto the reverse surface of the web 3 by the reverse side printing units 4B and 5B. The pair of light irradiation devices 15A and 15B which constitute the fixing device 6 have the same structure.

The light irradiation devices 15A and 15B are disposed such that their irradiation surfaces (to be described later) face down and up, respectively, with the web 3 being vertically sandwiched between them. Since the light irradiation devices 15A and 15B have the same structure, only the light irradiation device 15A will be described in detail with reference to FIG. 2. The light irradiation device 15A includes a box-shaped housing 17 having an irradiation opening 16*a* formed in an irradiation surface 16*b*, and an ozoneless type UV lamp (to be referred to as an ozoneless UV lamp hereinafter) 18 is fixed at the central portion of the housing 17, as shown in FIG. 2. Light emitted by the ozoneless UV lamp 18 is reflected by a reflecting mirror 19 and guided to the outside from the irradiation opening 16*a*.

The ozoneless UV lamp 18 employs silica glass containing a small amount of impurity in an arc tube of a UV lamp serving as a discharge lamp. Silica glass containing an impurity absorbs light having wavelengths in the ozone generation range to prevent ozone generation. Hence, light emitted by the ozoneless UV lamp 18 contains no wavelength in the ozone generation range (wavelengths less than 270 nm) which includes an ozone generation wavelength of 254 nm, as shown in FIG. 3. In contrast, light emitted by a metal halide lamp contains wavelengths in the ozone generation range. Also, an LED emits light containing no wavelength in the ozone generation range, and emits only light in the narrow wavelength range of 370 nm to 380 nm.

Figure 2:
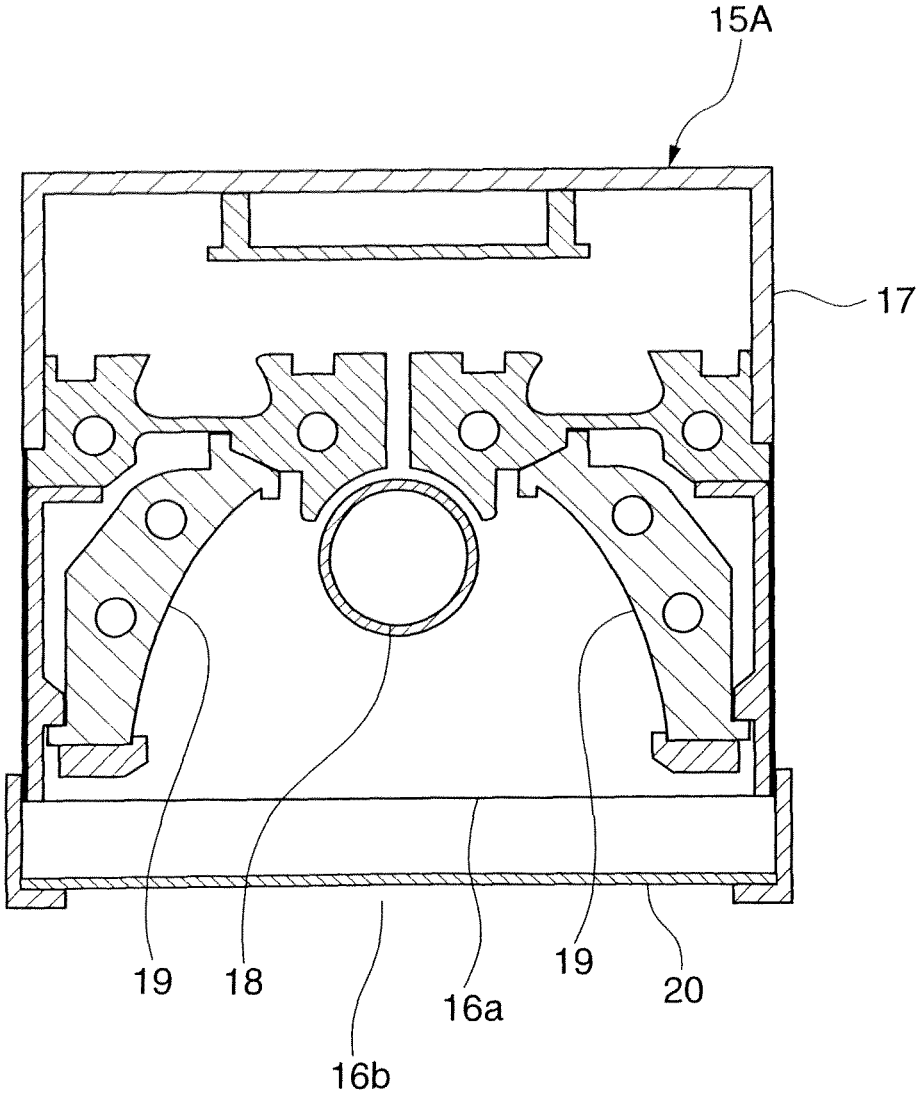
FIG. 2 is a sectional view of the main body of the web printing press shown in FIG. 1.
Figure 3:
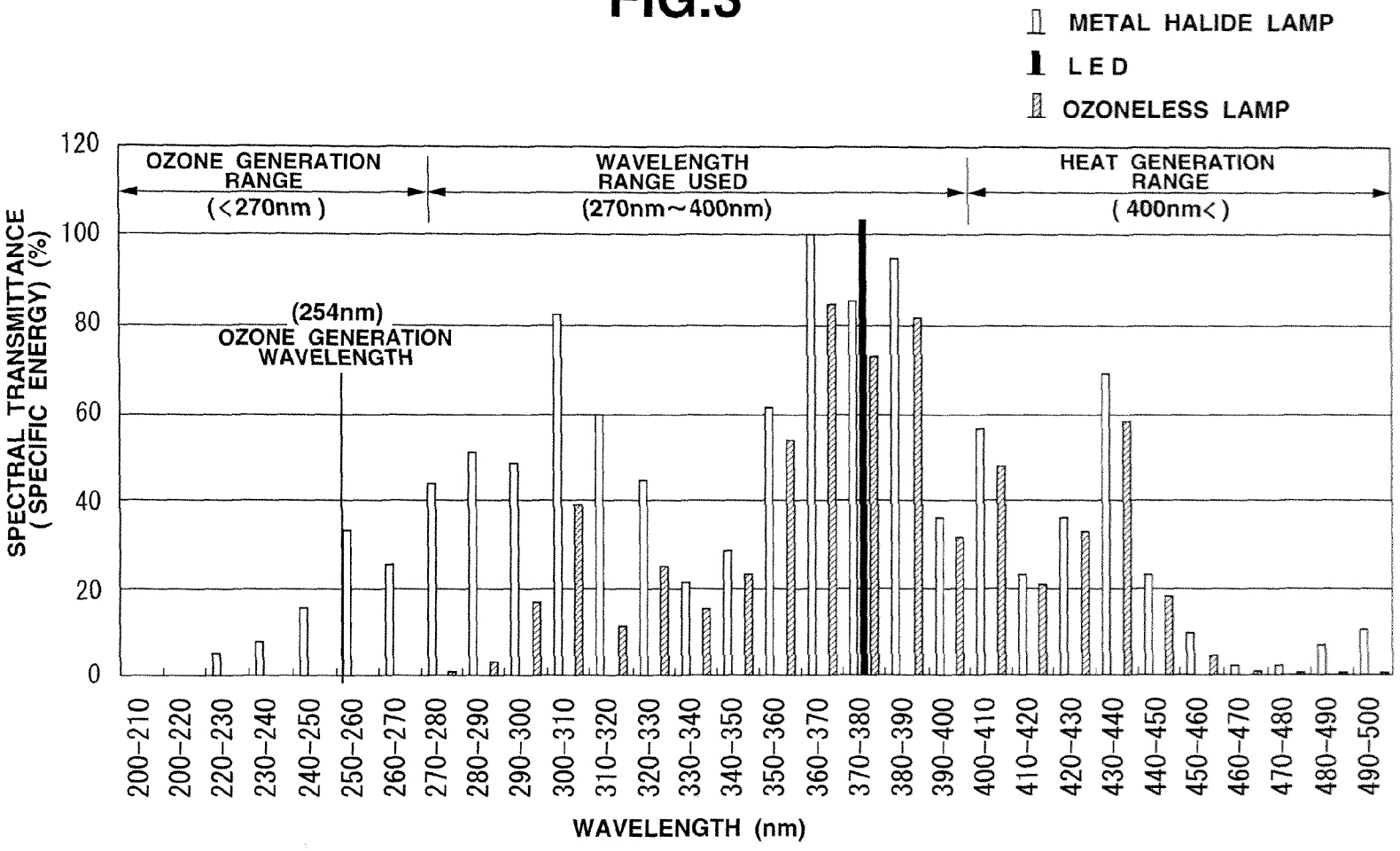
FIG. 3 is a graph showing the wavelength distribution of light emitted by an ozoneless lamp shown in FIG. 2.

As shown in FIG. 2, the light irradiation device 15A includes a cut filter (optical filter) 20 in the irradiation opening 16*a*. The cut filter 20 absorbs (cuts off) light wavelengths in the heat generation range, i.e., wavelengths more than 400 nm shown in FIG. 3 in light emitted by the ozoneless UV lamp 18. Therefore, the light irradiation device 15A emits light in the wavelength range of 270 nm to 400 nm upon filtering out wavelengths in both the ozone generation range and heat generation range via the irradiation surface 16*b*.

In this embodiment, a discharge lamp which emits light by discharge in a gas such as neon or xenon, the vapor of a metal such as mercury, sodium, or scandium, or a gas mixture thereof is employed as the ozoneless UV lamp 18. A light source of the light irradiation device 15A includes no LED. The light irradiation device 15A is defined as an ozoneless lamp which includes a discharge lamp and emits light having ultraviolet wavelengths including no ozone generation wavelength emitted by the discharge lamp.

Although an example in which the ozoneless UV lamp 18 which emits light containing no wavelength in the ozone generation range has been explained in this embodiment, a general discharge lamp which emits light containing an ozone generation wavelength may be employed in place of the ozoneless UV lamp 18. In this case, in addition to the cut filter 20 which absorbs wavelengths in the heat generation range, another cut filter which absorbs wavelengths in the ozone generation range need only be provided in the irradiation opening 16*a*. An ozoneless type UV lamp can be employed even when a cut filter which absorbs wavelengths in the ozone generation range is provided, as a matter of course. When there is no need to absorb wavelengths in the heat generation range, light from the ozoneless UV lamp 18 can be directly guided to the outside from the irradiation surface 16*b* without requiring the cut filter 20.

Also, although the wavelength range of light beams emitted by the light irradiation devices 15A and 15B is set to 270 nm to 400 nm, this does not limit the present invention to the condition in which the wavelength of light beams from the light irradiation devices 15A and 15B contains all wavelength components in this wavelength range. That is, wavelengths in an arbitrary range may be set as long as this range approximately falls within the wavelength range of 270 nm to 400 nm, so it is only necessary to set the lower limit of the wavelength to 260 nm to 300 nm and its upper limit to 380 nm to 420 nm. According to the present invention, by setting the wavelength of light beams from the light irradiation devices 15A and 15B to fall within the wide range of 270 nm to 400 nm, the highly reactive ink can be selected from various types of inks which react to light with a specific wavelength among a wide range of wavelengths, thus widening the range of options for ink.

A method of curing the highly reactive ink printed on the two surfaces of the web 3 by the light irradiation devices 15A and 15B in the web printing press 1 with the above-mentioned arrangement will be described next. Referring to FIG. 1, the web 3 fed from the sheet feeding device 2 to the printing unit 4 undergoes double-sided printing in the process of passing between the blanket cylinder 14A of the obverse side printing unit 4A and the blanket cylinder 14B of the reverse side printing unit 4B. Subsequently, the web 3 undergoes double-sided printing in the process of passing between the blanket cylinder 14A of the obverse side printing unit 5A in the printing unit 5 and the blanket cylinder 14B of the reverse side printing unit 5B in the printing unit 5.

The web 3 printed by the printing units 4 and 5 is irradiated with light beams from the light irradiation devices 15A and 15B, so the highly reactive ink transferred onto the two surfaces of the web 3 cures. At this time, because the light beams emitted by the light irradiation devices 15A and 15B contain no wavelength which generates ozone, no device for processing ozone is necessary. Also, because a low-power ozoneless lamp with a low light irradiation energy is employed, no cooling device is necessary, thereby making it possible to save both space and energy. Moreover, because of the use of highly reactive ink, the ink rapidly cures, so no large-sized thermal drying device is necessary, thereby making it possible to downsize the entire printing press.

In the dampening devices 13A and 13B, the two rollers which are in contact with each other are rotated so as to produce a counter-slip between them, so a given minimum necessary amount of dampening water is transferred from one roller to the other roller at a contact point A between them. Hence, an optimum amount of dampening water is supplied onto the plate surfaces of the printing plates mounted on the plate cylinders 11A and 11B to prevent excessive emulsification of the highly reactive ink supplied from the inking devices 12A and 12B onto these plate surfaces. This makes it possible to keep the highly reactive ink in an optimum emulsified state, thereby reliably curing the highly reactive ink despite its irradiation by the ozoneless UV lamp 18 with a low light irradiation energy.

By filtering out wavelengths in the heat generation range from light emitted by the ozoneless UV lamp 18, the amount of heat acting on the web 3 is reduced, so thermal deformation of the web 3 is prevented. This makes it possible to improve the quality of a printing product. The web 3 on which the highly reactive ink printed on its two surfaces has cured with light beams emitted by the light irradiation devices 15A and 15B undergoes cutting and folding processing by the folder 8, and is delivered.

Second Embodiment

Figure 4:
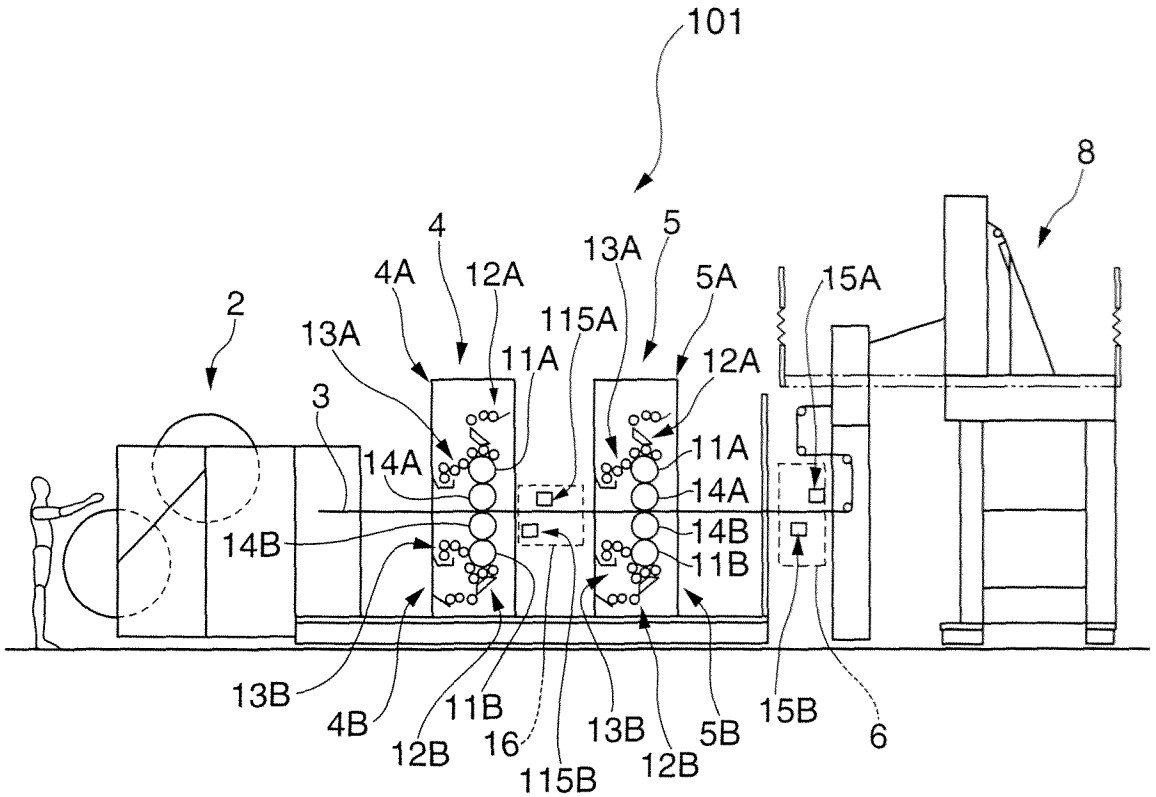
FIG. 4 is a side view of a web printing press according to the second embodiment.
Figure 5:
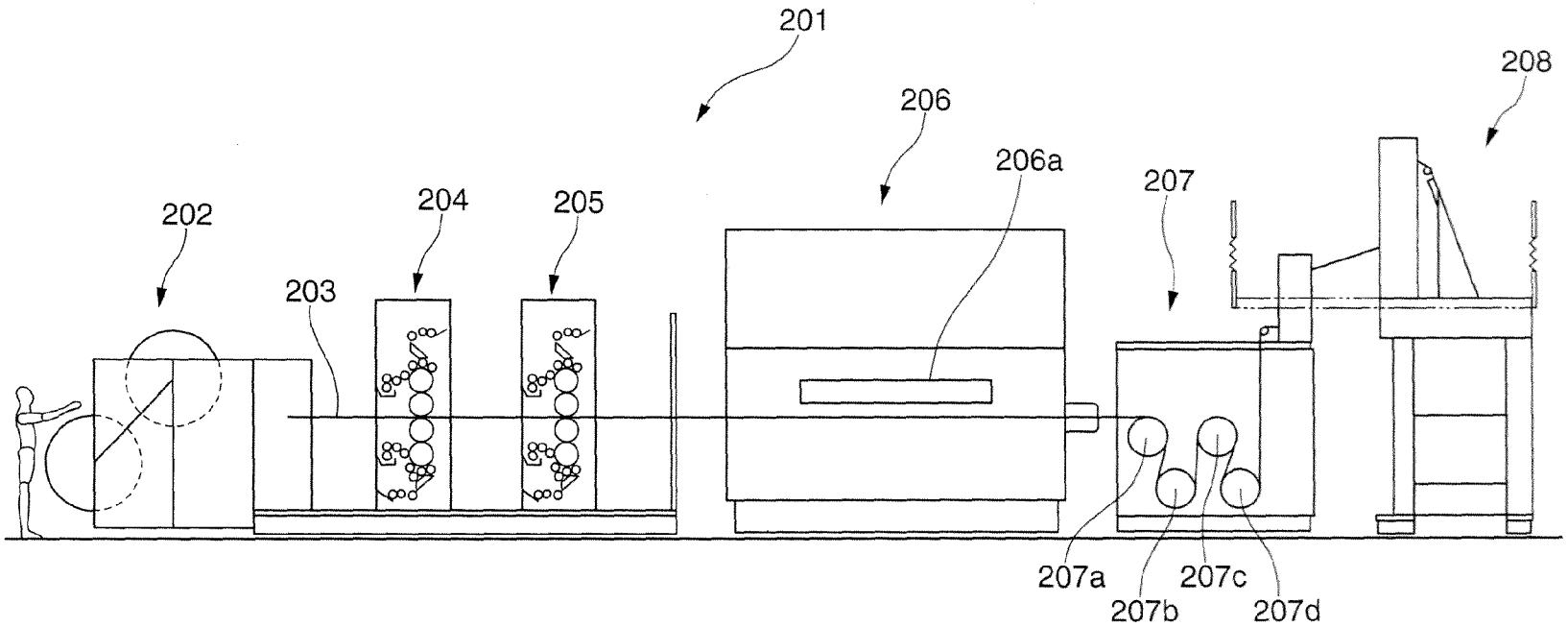
FIG.5 PRIOR ART
FIG. 5 is a side view of a conventional web printing press.

The second embodiment of the present invention will be described next with reference to FIG. 4.

The second embodiment is different from the first embodiment in that in the former a fixing device 16 including a pair of light irradiation devices 115A and 115B is provided between printing units 4 and 5, in addition to a fixing device 6 including a pair of light irradiation devices 15A and 15B. The light irradiation devices 115A and 115B are disposed such that their irradiation surfaces face down and up, respectively, with a web 3 being vertically sandwiched between them.

In this arrangement, as for the web 3 having undergone double-sided printing by the printing unit 4, the highly reactive ink transferred onto the two surfaces of the web 3 cures with light beams emitted by the light irradiation devices 115A and 115B. Next, as for the web 3 having undergone double-sided printing by the printing unit 5, the highly reactive ink transferred onto the two surfaces of the web 3 cures with light beams emitted by the light irradiation devices 15A and 15B.

Although an example in which highly reactive ink is printed on the web 3 has been explained in each of the above-mentioned embodiments, the present invention may be applied to a coating unit/coating device which coats the web 3 using highly reactive varnish as a highly reactive transfer liquid. Also, although an example in which one or two pairs of light irradiation devices are provided has been explained, three or more pairs of light irradiation devices may be provided as needed.

According to the present invention, highly reactive ink/varnish rapidly cures upon irradiation with light having a specific wavelength, thus making it possible to downsize the entire printing press without requiring a large-sized thermal drying device as a fixing device. Also, highly reactive ink can sufficiently cure despite the use of a low-power ozoneless lamp, thus making it possible to provide an environment-friendly printing/coating apparatus which attains ozoneless, energy-saving printing/coating. Moreover, no device for processing ozone is necessary because of the use of ozoneless printing/coating, thus making it possible to save energy in this respect as well. Not only a cooling device for removing the generated heat but also a duct and a peripheral device are unnecessary because of the use of a low-power ozoneless lamp, thus making it possible to save space.

From the standpoint of an ink manufacturer, there is no need to develop ink assuming the use of light with limited wavelengths, such as an LED-UV. Hence, the ink manufacturer can develop ink which rapidly cures with an arbitrary wavelength among a wide range of wavelengths output from an ozoneless lamp. This means that the ink manufacturer can develop ink with good printing quality that is the original goal of ink.

By filtering out wavelengths in the heat generation range from light emitted by an ozoneless lamp, the amount of heat acting on the web is reduced, so thermal deformation of the web is prevented. This makes it possible to improve the quality of a printing product. Because highly reactive ink/varnish can be selected from various types of inks/varnishes which react to an arbitrary wavelength among a wide range of wavelengths, the range of options for ink widens.

What is claimed is:

1. A web printing apparatus including a transfer device which transfers highly reactive ink/varnish onto a web, and a fixing device which fixes, on the web, the highly reactive ink/varnish transferred by the transfer device and comprises a light irradiation device that includes a UV-lamp including no LED, the fixing device not including a thermal drying device, wherein said light irradiation device irradiates the web with light containing all wavelength components in a wavelength range of 270 nm to 400 nm to cure the highly reactive ink/varnish on the web without thermal drying of the web, and wherein said light irradiation device irradiates the web with the light containing no wavelength which is less than 270 nm and no wavelength which is greater than 400 nm.

2. An apparatus according to claim 1, wherein the highly reactive ink/varnish transferred onto the web by the transfer device cures with the light, which is emitted by said light irradiation device and has the wavelength range in which no ozone is generated, without cooling after the thermal drying of the web.

3. An apparatus according to claim 1, wherein the transfer device transfers the highly reactive ink/varnish onto an obverse surface and reverse surface of the web, and said light irradiation device comprises a first ozoneless lamp which irradiates the obverse surface of the web with light to cure the highly reactive ink/varnish transferred onto the obverse surface of the web, and a second ozoneless lamp which irradiates the reverse surface of the web with light to cure the highly reactive ink/varnish transferred onto the reverse surface of the web.

4. An apparatus according to claim 1, wherein said light irradiation device irradiates the web with light from which a wavelength in a heat generation range is filtered out.

5. An apparatus according to claim 1, wherein the highly reactive ink/varnish cures with a specific wavelength in the wavelength range of the light which impinges on the web.

6. A web printing apparatus including an ink/varnish supply device which supplies UV-reactive ink/varnish, a transfer device which is adapted to transfer to a web the UV-reactive ink/varnish, a fixing device, which fixes, on the web, the UV-reactive ink/varnish transferred by the transfer device, wherein the fixing device comprises a UV-light irradiation device that includes a UV-lamp including no LED, which is adapted to emit to the web the UV-light of a wavelength range in which no ozone is generated, to cure the UV-reactive ink/varnish on the web without thermal drying of the web, the fixing device not including a thermal drying device, and wherein the UV-lamp generates light containing all wavelength components in a wavelength range of 270 nm to 400 nm and irradiates the web with the light, to thereby fix the UV-reactive ink/varnish transferred on the web, and the UV light irradiation device irradiates the web with the light containing no wavelength which is less than 270 nm and no wavelength which is greater than 400 nm.

* * * * *